US005682950A

United States Patent [19]

Bjørnstad

[11] Patent Number: 5,682,950

[45] Date of Patent: Nov. 4, 1997

[54] MEANS FOR COLLECTING UNWANTED MATERIAL IN AN OIL OR GAS WELL

[75] Inventor: Thor Bjørnstad, Mandal, Norway

[73] Assignee: Den Norske Stats Oljeselskap A.S., Stavanger, Norway

[21] Appl. No.: 561,982

[22] Filed: Nov. 22, 1995

[30] Foreign Application Priority Data

Nov. 25, 1994 [NO] Norway ..... 944539

[51] Int. Cl.[6] ..... D21B 31/16

[52] U.S. Cl. ..... 166/99; 175/312

[58] Field of Search ..... 166/99, 55.7; 175/312

[56] References Cited

U.S. PATENT DOCUMENTS

| | | | |
|---|---|---|---|
| 1,472,213 | 10/1923 | Gilstrap . | |
| 1,656,526 | 1/1928 | Lincoln . | |
| 2,169,922 | 8/1939 | Notley . | |
| 2,890,756 | 6/1959 | Middleton | 166/99 |
| 3,520,359 | 7/1970 | Ehrlich | 166/99 X |
| 4,696,502 | 9/1987 | Desai | 166/99 X |
| 5,176,208 | 1/1993 | Lalande et al. . | |

FOREIGN PATENT DOCUMENTS

| | | | |
|---|---|---|---|
| 0376433 | 7/1990 | European Pat. Off. . | |
| 685406 | of 1952 | United Kingdom | 166/99 |
| WO 92/19838 | 11/1992 | WIPO . | |

*Primary Examiner*—William P. Neuder

*Attorney, Agent, or Firm*—Clifford W. Browning; Woodard, Emhardt, Naughton, Moriarty & McNett

[57] ABSTRACT

Means for collecting and bringing up unwanted material from an oil or gas well, the means thereby comprising a grinder or mill (6) and a coating (8) of a wear resistant material along its front and outer surfaces, the mill (6) being secured to a throughgoing drilling pipe having an inner centric liquid channel (7), the axially leading facing end of the mill (6) comprising a channel (4) extending through the mill (6) and into a junk chamber (3) behind or after the mill (6), the upper end of the means comprising a strainer (2) allowing penetration of liquid, but restraining the material, the rotation of the means from the throughgoing drilling pipe thereby ensuring that junk is brought into the channel (4) and from here into the junk chamber (3).

12 Claims, 1 Drawing Sheet

MEANS FOR COLLECTING UNWANTED MATERIAL IN AN OIL OR GAS WELL

The present invention is related to a means for collecting unwanted material in an oil or gas well.

Means of the above mentioned type especially are used during completing and maintenance of wells, normally being denoted junk collectors. Unwanted material in a well may be loose or fixed material or objects.

Within the oil technology several known developments are known for removing material from a well. Mostly these have been developed and are used in wells extending vertically. With the development of deviation wells the need has arisen for using junk collectors being effective also in cases where a substantially horizontal well shall be completed or maintained.

GB 2 206 508 describes a junk collector having "shelves" intended to collect the junk when the fluid flow is given a centrifugal movement. Another embodiment is disclosed in U.S. Pat. No. 4,603,739 and comprises scrapers gliding along the casing wall thereby bringing the collected junk into a chamber in the junk collector, which chamber is closed by valves. By means of these valves the material is collected in the chamber which later can be taken up to the surface and emptied. Other such embodiments are described in U.S. Pat. No. 4,703,804 and U.S. Pat. No. 4,838,354.

SUMMARY OF THE INVENTION

With the means according to the present invention collecting loose and jammed material or objects in all types of wells, vertical as well as deviation wells, is made possible. This is achieved with the means according to the invention as defined with the features stated in the claims.

Several means according to the invention may be secured to the drilling pipe and brought down into the well by means of the drilling pipe, one to clean and remove material from the production pipe and one to clean and polish the transition between the casing (normally 8½" inwardly) and the production pipe or liner (normally 6" inwardly).

BRIEF DESCRIPTION OF THE DRAWINGS

In the drawing FIG. 1 discloses an axial cross section through one embodiment of a means according to the present invention, FIG. 2 discloses a corresponding axial section through a further embodiment, FIG. 3 discloses an axial view seen from the left hand side of FIG. 1, FIG. 4 discloses an axial view seen from the left hand side of FIG. 2 and FIG. 5 discloses schematically the use of the means according to the present invention in a section through a formation, a casing pipe and a production pipe.

DETAILED DESCRIPTION OF THE PREFERRED EMBODIMENTS

Figure 1:
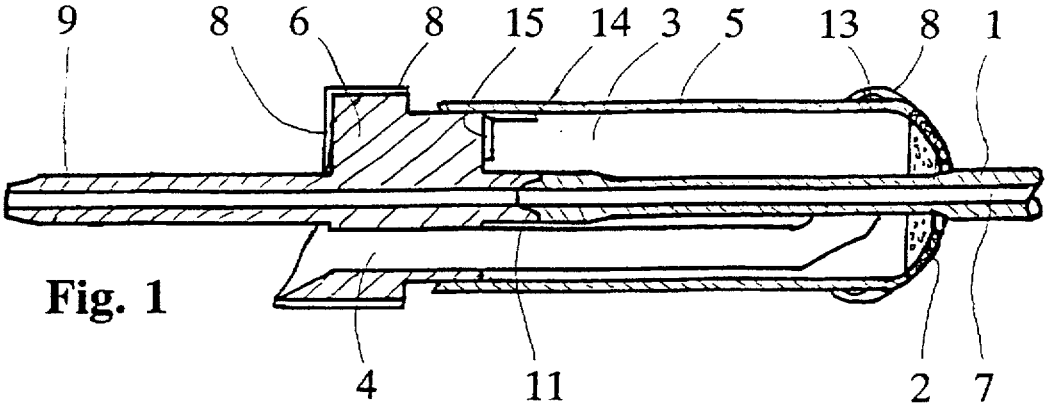

FIG. 1 discloses the means connected with a drilling pipe 1, comprising a throughgoing centric channel 7 for transfer of drilling fluid. The means or the tool comprises a grinding device or mill 6 having an outer diameter with tolerances corresponding with the inner diameter of the pipe in which the means is intended to work. The drilling pipe 1 with its fluid channels 7 extends through the mill 6. The outer surface 8 of the mill is covered by a material being specially resistant to wear, such as tungsten carbide. The mill 6 comprises a channel 4 through which drilling fluid and milled material or other junk from the well is pressed when the means with the drilling pipe is pulled down into the well. The junk is pressed into the junk chamber 3, whereas the drilling fluid will be pressed out through a strainer 2 arranged at the upper end of the means.

In the front area of the junk chamber there preferably are arranged magnets 14 and 15 which are secured to, but isolated from, the outer wall 5 of the chamber or to the mill 6. These magnets will ensure that magnetic material will remain in the junk chamber 3.

A bead 13 is arranged near the upper end of the means. This bead 13 has an outer diameter substantially corresponding with the diameter of the mill, namely the outer diameter which with tolerances should correspond with the inner diameter of the pipe in which the means is intended to operate. On the outer surface of the bead a wear resistant material 8, preferably a layer of tungsten carbide, is arranged.

If problems arise in taking the tool out of the well, for example may objects or material parts hinder hauling of the pipe or make it difficult, this bead 13 with its tungsten carbide layer 8 may function as a mill when the tool is rotated by the drilling string. This will ensure safe hauling of the tool. Additionally the tool thereby will be more stable in the direction as the upper end of the tool has substantially the same diameter as the mill.

Figure 2:
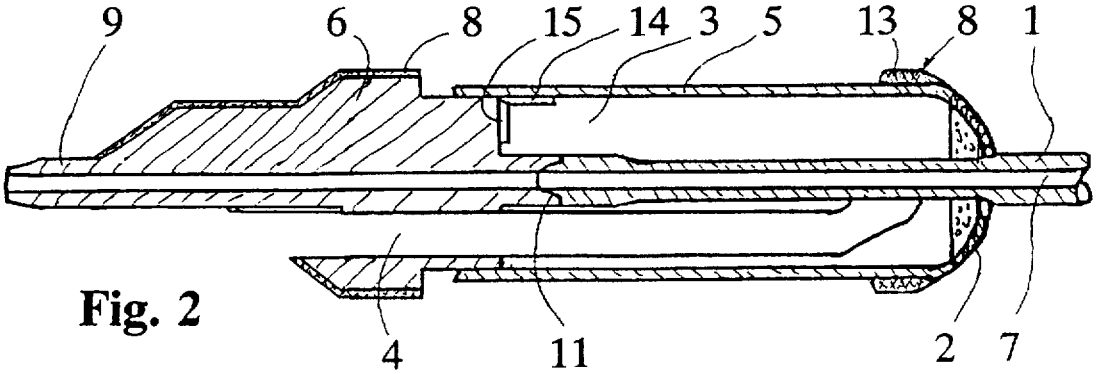
Figure 3:
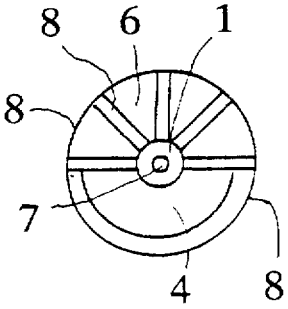
Figure 4:
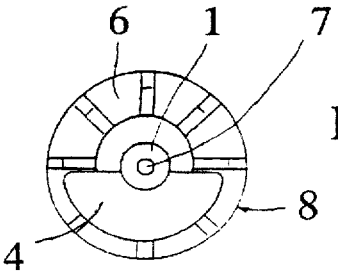

The means according to FIG. 2 typically will be used to polish the transition from casing pipe to production pipe. As the production pipe has smaller diameter than the casing pipe, the means disclosed in FIG. 2 is meant to be brought down into the casing pipe until it lands on the start of the production pipe. The outer diameter of the equipment will correspond with the diameter of the casing pipe.

The means according to FIG. 2 will provide the necessary polishing of the transition between the casing pipe and the production pipe.

It may be suitable to arrange a junk collector as disclosed in FIG. 1 having a diameter corresponding with the inner diameter of the production pipe and a junk collector as disclosed in FIG. 2 having a diameter corresponding with the inner diameter of the casing pipe, both on the same drilling pipe. They then will be arranged after each other, having a distance such as the length of the production pipe in the well. It then will be possible in the same operation to complete an entire well, its production pipe and its casing pipe and simultaneously to polish the transition between the production pipe and the casing pipe at the same time.

The mill 6 may have a cylindric and conical-spiral outer shape. Furthermore the mill 6 preferably comprises two substantially semi cylindrical parts having different outer diameters and having between the outer and middle and between this and the outer diameter of the drilling pipe conical and spiral leading ends, likewise being coated with wear resistant material.

FIG. 1 discloses that the strainer 2 is arranged at the upper end of the junk collector and surrounds the drilling pipe 7. The apertures of the strainer 2 may be displaced across the entire diameter of the chamber, or only across parts of it.

Important with the present invention is a means which can be brought down into the well, rotated by means of the drilling pipe to mill unwanted objects or material and which collects this well junk in a suitable junk chamber. The drilling pipe provided with one or more junk collectors thereafter is hauled up to the surface where the junk store is emptied. The junk collector leaves a clean and completed well.

Figure 5:
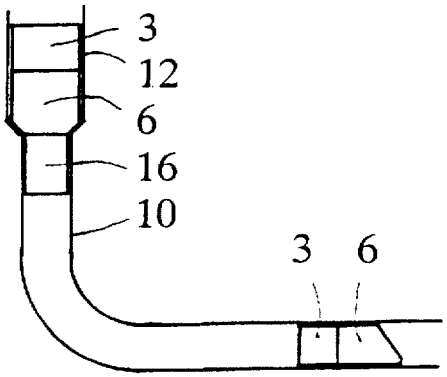

The junk collector according the present invention ensures that junk is forced all the way into the junk chamber 3 when the drilling pipe and thereby the junk collector is rotated. FIG. 5 discloses an example of how the junk collector according to the present invention may be utilized in practical operation. A leading junk collector having a mill 6 and a junk chamber 3 is secured to the end of the drilling pipe and is brought in to the horizontal part of the production pipe 10. At a fixed distance from the leading junk collector a PBR or reamer 16 is arranged in such a way that it reams the first portion of the production pipe 10 after the transition from the casing pipe. An upper junk collector, likewise with a mill 6 and a junk chamber 3, thereby fits against the transition between the casing pipe 12 and the production pipe 10.

I claim:

1. Means for collecting and bringing up unwanted junk material from an oil or gas well, comprising a grinder or mill (6) having front and outer surfaces and a coating (8) of a wear resistant material along said front and outer surfaces, said mill (6) being secured to a throughgoing drilling pipe having an inner centric liquid first channel (7), said mill (6) further comprising a second channel (4) extending through said mill (6) and into a junk chamber (3) behind or after said mill (6), said junk chamber having at its distal end a strainer (2) allowing penetration of liquid, but restraining the unwanted material, whereby the rotation of said means with the rotation of said throughgoing drilling pipe ensures that unwanted junk material is brought into said second channel (4) and from said second channel (4) into said junk chamber (3).

2. Means according to claim 1 wherein the faces of the front and outer surfaces of said mill (6) have several forwardly protruding webs or cutters coated with wear resistant material.

3. Means according to claim 2 wherein said wear resistant material is tungsten carbide.

4. Means according to claim 3, wherein the front end of said second channel (4) has a funnel shape to assist bringing the material into said second opening.

5. Means according to claim 4 and further comprising a bead (13) arranged around the outer wall (5) of said means, near said strainer (2), the bead (13) being axially rounded and having a coating of wear resistant material, with the largest diameter of the bead (13) being substantially the same as, but not larger than, the outer diameter of said mill (6).

6. Means according to claim 5 and further comprising at least one magnet plate (14, 15) being arranged in said junk chamber (3), and secured to, respectively, said mill (6) and the inner wall of the cylindrical wall (5), and being adapted to capture collected junk.

7. Means for collecting and bringing up unwanted junk material from an oil or gas well, comprising a grinder or mill (6) having front and outer surfaces and a coating (8) of a wear resistant material along said front and outer surfaces, said mill (6) being secured to a throughgoing drilling pipe having an inner centric liquid first channel (7), said mill (6) further comprising a second channel (4) extending through said mill (6) and into a junk chamber (3) behind or after said mill (6), said junk chamber having at its distal end strainer (2) allowing penetration of liquid, but restraining the unwanted material, whereby the rotation of said means with the rotation of said throughgoing drilling pipe ensures that unwanted junk material is brought into said second channel (4) and from said second channel (4) into said junk chamber (3), said mill (6) further comprising two substantially semi cylindrical parts having different outer diameters and having disposed between the outer most of said parts and the outer diameter of said throughgoing drilling pipe conical and spiral leading ends coated with wear resistant material.

8. Means according to claim 7, wherein the faces of the front and outer surfaces of said mill (6) have several forwardly protruding webs or cutters coated with wear resistant material.

9. Means according to claim 8, wherein said wear resistant material is tungsten carbide.

10. Means according to claim 9, wherein the front end of said second channel (4) has a funnel shape to assist bringing the material into said second opening.

11. Means according to claim 10 and further comprising a bead (13) arranged around the outer wall (5) of said means, near said strainer (2), the bead (13) being axially rounded and having a coating of wear resistant material, with the largest diameter of the bead (13) being substantially the same as, but not larger than, the outer diameter of said mill (6).

12. Means according to claim 11, and further comprising at least one magnet plate (14, 15) being arranged in said junk chamber (3), and secured to respectively said mill (6) and the inner wall of the cylindrical wall (5), and being adapted to capture collected junk.

* * * * *